US006739253B2

(12) United States Patent
Schaum

(10) Patent No.: US 6,739,253 B2
(45) Date of Patent: May 25, 2004

(54) SHEET-FED PRINTING MACHINE

(75) Inventor: Frank Schaum, Neckargemünd (DE)

(73) Assignee: Heidelberger Drukcmaschinen AG, Heidelberg (DE)

( * ) Notice: Subject to any disclaimer, the term of this patent is extended or adjusted under 35 U.S.C. 154(b) by 0 days.

(21) Appl. No.: 09/844,914

(22) Filed: Apr. 27, 2001

(65) Prior Publication Data

US 2002/0011707 A1 Jan. 31, 2002

(30) Foreign Application Priority Data

Apr. 27, 2000 (DE) ..... 100 20 648

(51) Int. Cl.[7] ..... B41F 21/00

(52) U.S. Cl. ..... 101/232; 101/480; 101/174; 271/10.01

(58) Field of Search ..... 101/142, 171, 101/174, 175, 177, 154, 216, 217, 232, 246, 409, 479, 480; 271/10.01, 245, 275, 277, 204, 82

(56) References Cited

U.S. PATENT DOCUMENTS

| | | | | |
|---|---|---|---|---|
| 3,002,450 A | | 10/1961 | Papa et al. | 101/137 |
| 4,370,928 A | | 2/1983 | Weisbach et al. | 101/242 |
| 4,441,423 A | | 4/1984 | Germann | 101/211 |
| 4,732,084 A | * | 3/1988 | Wirz | 101/177 |
| 4,825,762 A | * | 5/1989 | Fischer | 101/142 |
| 5,156,638 A | * | 10/1992 | Wirz | 101/142 |
| 5,638,752 A | | 6/1997 | Hartung et al. | 101/177 |
| 5,873,309 A | * | 2/1999 | Mack et al. | 101/232 |
| 6,019,046 A | * | 2/2000 | Rodi | 101/214 |
| 6,349,641 B1 | * | 2/2002 | Bayer et al. | 101/142 |

FOREIGN PATENT DOCUMENTS

| | | |
|---|---|---|
| DE | 30 08 226 C2 | 10/1980 |
| DE | 91 16 208.4 | 5/1992 |
| DE | 42 30 568 A1 | 3/1994 |
| DE | 43 43 616 A1 | 6/1995 |
| DE | 44 35 307 A1 | 4/1996 |
| DE | 296 23 064 U1 | 11/1997 |
| DE | 299 14 812 U1 | 11/1999 |
| EP | 0 620 115 B1 | 10/1994 |
| EP | 0 870 609 A2 | 10/1998 |

* cited by examiner

*Primary Examiner*—Leslie J. Evanisko
(74) *Attorney, Agent, or Firm*—Laurence A. Grenberg; Werner H. Stemer; Ralph E. Locher

(57) ABSTRACT

A sheet-fed printing machine made up of units in an in-line construction includes a sheet-feeding unit disposed between a sheet separating unit and a sheet processing unit following the sheet separating unit. The sheet feeding unit is formed so that it is selectively pre-arrangeable upline from various types of sheet processing units for creating various types of sheet-fed printing machines of a building block system.

27 Claims, 1 Drawing Sheet

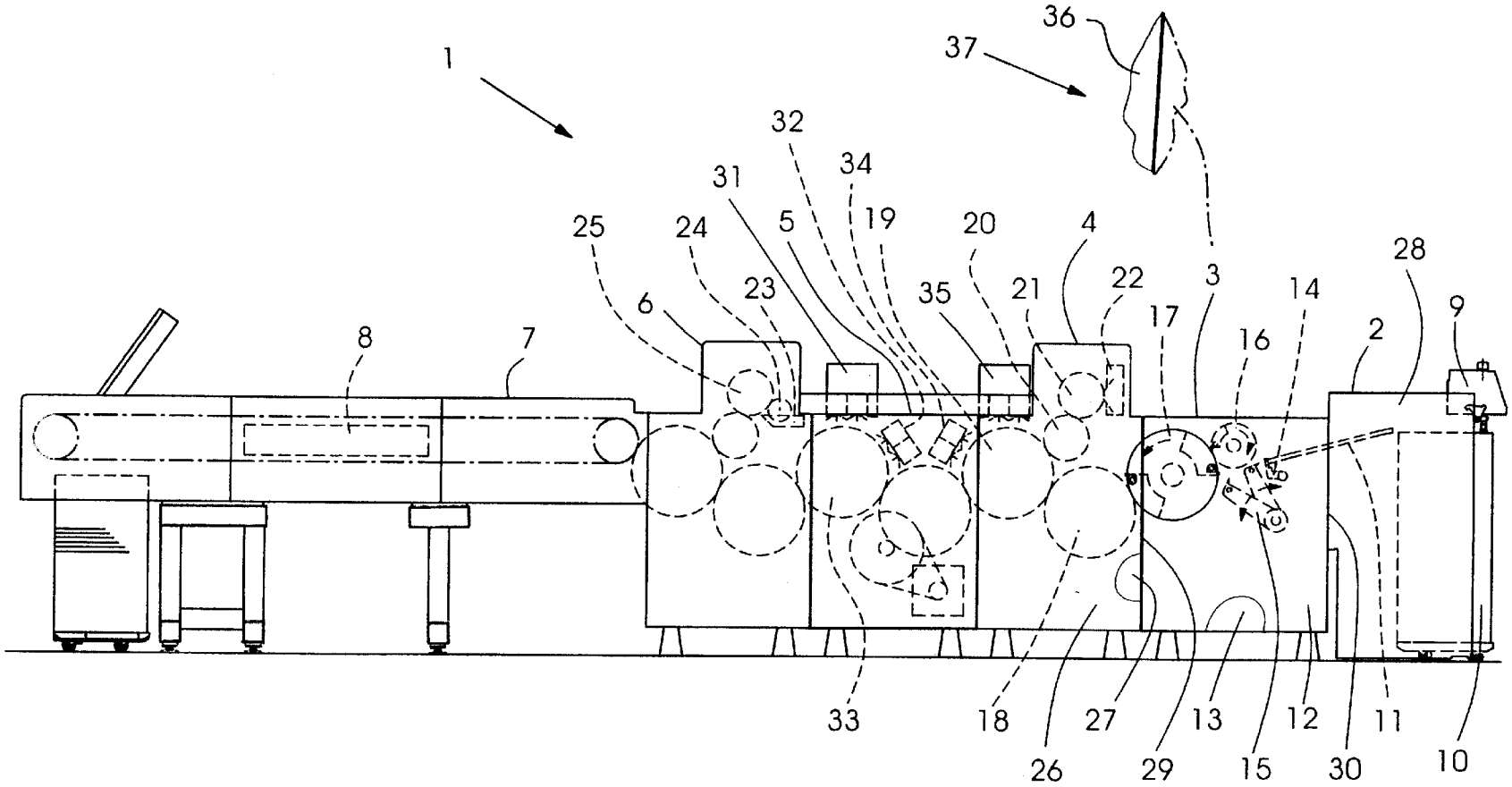
1
2
3
4
5
6
7
8
9
10
11
12
13
14
15
16
17
18
19
20
21
22
23
24
25
26
27
28
29
30
31
32
33
34
35
36
37

SHEET-FED PRINTING MACHINE

BACKGROUND OF THE INVENTION

Field of the Invention

The invention relates to a sheet-fed printing machine or press, composed of units in an in-line construction.

Such printing machines are made up of individual offset printing units, flexographic printing units (varnishing or coating units) and finishing units (perforating, stamping, embossing units or the like); the aforementioned sheet processing units are disposed in an order that suits the customer-specific requirements.

In one case, for example, it may be necessary for the flexographic printing unit to precede the offset printing units, while in another case the flexographic printing unit is downline of the offset printing units (note the published European Patent Document EP 0 620 115 B1, FIGS. 1 and 2). The number of offset printing units and the number of flexographic printing units can also differ from one printing machine to another.

In the interest of rationalizing the manufacture of printing machines, printing machine manufacturers have created a building block or modular system for every model series of printing machine in question; such a system includes the various sheet processing units and other assemblies (such as an inverter, a sheet delivery, and so forth) of that particular model series. However, within one building block system, there are structural differences between the so-called feeder printing unit on the one hand and the printing units located in the second, third, fourth position and so forth.

The special feature of a feeder printing unit is, in fact, that it includes a sheet feeder system, which can, for example, include a pre-gripper and a feed drum (note the published German Patent Document DE 30 08 226 C2), and that it is embodied in a special manner in the interest of integrating the sheet feeder system. The structural consideration as to whether a sheet processing unit is disposed first, in terms of the sheet transport direction, or in the first position that follows the sheet separating unit, results in increased production costs.

It has also not been possible to solve this problem with the sheet-fed printing presses described in the published German Patent Documents DE 42 30 568 A1, DE 44 35 307 A1, and DE 296 23 064 U1 (the latter for a German utility model).

In the published German Patent Document DE 43 43 616 A1, a modular printing press system is described which includes printing presses which process sheets of paper, and printing presses which process sheets of cardboard; these printing presses are assembled from prefabricated structural groups in accordance with the needs of the customer. The manufacturer selectively equips the printing presses with a standard feeder and with a standard feed assembly, the latter including a feed drum and a pre-gripper, so as to make it possible to process the sheets of paper. By an exchange of assemblies, wherein, instead of the standard feeder, a tall stack or pile feeder, and instead of the standard feed assembly, a tall-version feed assembly are used, the printing press can be selectively equipped, without further modifications or adaptations in the production process, to process the sheets of cardboard as well. The last German patent document identified hereinabove accordingly teaches that for every type of printing press within a building block system, a different, special feed assembly must be used. It is true that in this way a customer-specific and yet rapid outfitting of the printing press or printing machine is possible, but the production costs cannot be lowered sufficiently in this way.

SUMMARY OF THE INVENTION

It is therefore an object of the invention to provide a sheet-fed printing machine by the structural features of which the manufacture of the printing machine can be rationalized further.

With the foregoing and other objects in view, there is provided, in accordance with the invention, a sheet-fed printing machine made up of units in an in-line construction, comprising a sheet-feeding unit disposed between a sheet separating unit and a sheet processing unit following the sheet separating unit, the sheet feeding unit being formed so that it is selectively pre-arrangeable upline from various types of sheet processing units for creating various types of sheet-fed printing machines of a building block system.

In accordance with another feature of the invention, the sheet processing unit is a printing unit.

In accordance with a further feature of the invention, the sheet-fed printing machine includes at least another sheet processing unit following the sheet separating unit, the sheet-feeding unit being disposed between the sheet separating unit and a first one of the sheet processing units.

In accordance with an added feature of the invention, the sheet feeding unit includes at least one lay mark.

In accordance with an additional feature of the invention, the sheet feeding unit includes a pre-gripper.

In accordance with yet another feature of the invention, the sheet feeding unit includes a feed drum.

In accordance with yet a further feature of the invention, the sheet feeding unit includes a sheet transport drum.

In accordance with yet an added feature of the invention, the sheet transport drum is of multiple size.

In accordance with yet an additional feature of the invention, the printing unit is a flexographic printing unit.

In accordance with still another feature of the invention, the printing unit includes a zoneless metering device.

In accordance with a concomitant feature of the invention, the metering device includes a screen roller and a chambered doctor blade.

In a building block system including such printing machines as are produced in accordance with the invention, an advantage is attained in that the sheet processing unit, when disposed in a first position downline can be embodied structurally exactly the same as when disposed at the second, third, fourth or later positions. By reducing the number of modified forms of the sheet processing units within the building block system, greater rationalization of production is achieved, and production costs are consequently reduced.

Increased modularity of the building block system is also attained as a result of the fact that advantageously one and the same sheet feeding unit can be disposed preceding various kinds of sheet processing units, as needed. For example, the sheet feeding unit in one printing machine can immediately precede an offset printing unit, while in another printing machine it can immediately precede a flexographic printing unit. At least one offset printing unit can be disposed following the offset or flexographic printing unit that is immediately preceded by the sheet feeding unit.

The sheet separating or singling unit serves to single out or separate the sheets of printing material from a pile of sheets, and thereafter transports the sheets, separated from the sheet pile, to the sheet feeding unit either as single sheets or in a stream arrangement.

The function of the sheet feeding unit is to take over the sheets, which arrive from the sheet separating unit, and transfer these sheets in-register to the sheet processing unit. The sheet feeding unit is thus required to have only one sheet transporting device and/or one sheet aligning device. The sheet feeding unit does not have to include a device for processing the sheets, such as a printing device.

Hereinafter described and in various respects advantageous improvements in the sheet-fed printing machine according to the invention are possible.

The sheet aligning device of the sheet feeding unit can be formed of a front lay mark and/or a side lay mark. The sheet transport device of the sheet feeding unit can be formed of an oscillating pre-gripper and/or a revolving feed drum.

In addition to the pre-gripper and/or the feed drum, a sheet transport drum can be rotatably mounted in the sheet feeding unit; the transport drum is disposed between the sheet aligning device and a cylinder of the sheet processing unit.

The circumference of the sheet transport drum can be twice as large, or more than twice as large, as the sheet format length.

In one possible embodiment of the sheet processing unit as a finishing unit, this unit can include a cutting tool for severing the sheet, such as a perforating tool, for example; or a deforming tool for deforming the sheet, such as an embossing tool, for example; or a cleaning tool for cleaning the sheet, such as a dust removing brush, for example.

The sheet processing unit can, however, also be embodied as an offset press unit, a letterpress unit, or a flexographic printing unit. The latter can, for example, precede a plurality of offset printing units of the sheet-fed printing press and can serve the purpose of coating the sheet over the full surface thereof or selected areas thereof with an opaque or zinc white, a metallic-effect ink, a varnish, or the like.

With such use of the printing unit as a coating unit, this printing unit can be equipped with a zoneless metering device for metering the ink or varnish uniformly over the printing width. For example, the metering device can be formed of an immersion or dip roller disposed in a tub of ink or varnish, and a metering roller in contact with the dip roller; together, these rollers define a metering gap that is adjustable with respect to what can pass therethrough.

The metering device is preferably formed of a screen or anilox roller, however, against which a chambered doctor blade lies.

The sheet-fed printing machine can be embodied as an offset rotary printing machine, a flexographic rotary printing machine, or a so-called hybrid printing machine. A hybrid printing machine is distinguished in that it has at least two printing units which print in accordance with mutually different printing principles (such as an offset printing unit and a flexographic printing unit, for example).

Other features which are considered as characteristic for the invention are set forth in the appended claims.

Although the invention is illustrated and described herein as embodied in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Other features which are considered as characteristic for the invention are set forth in the appended claims.

Although the invention is illustrated and described herein as embodied in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings wherein:

BRIEF DESCRIPTION OF THE DRAWING

The single unidentified FIGURE is a diagrammatic side elevational view of the sheet-fed printing machine.

DESCRIPTION OF THE PREFERRED EMBODIMENTS

Referring now to the unidentified sole FIGURE of the drawing, there is shown therein a sheet-fed printing machine or printing press 1 assembled, in the order named, from a sheet separating or singling unit 2, a sheet feeding unit 3, a printing unit 4, a drying unit 5, a further printing unit 6, and a sheet delivery 7, with an integrated drying system 8.

The sheet separating unit 2 includes, as a separator device, a suction head 9 with a separating suction cup for lifting single sheets from a sheet pile 10. The sheet separating unit 2 furthermore includes a feeder tray or feeding table 11, which protrudes out of the sheet separating unit 2 and into the sheet feeding unit 3. On the feeding table 11, the sheets are transported from the sheet separating unit 2 to the sheet feeding unit 3.

The sheet feeding unit 3 has two side walls 12 and 13 forming a frame, and further includes a lay mark or feed lay 14, a pre-gripper 15, a feed drum 16, and a sheet transport drum 17, which are supported between the side walls 12 and 13 in the sheet feeding unit 3.

After the leading or front edge of a sheet, which has been transported to the end of the feeding table 11, has abutted the lay mark 14 and, as a result, has been aligned parallel to the gripper edge of the pre-gripper 15, the latter can grip 20 the sheet and transfer it to the feed drum 16, which is embodied as a drum of standard, single size and is equipped with a single row of grippers for holding the sheet.

The sheet transport drum 17, a sheet transport cylinder 18 of the printing unit 4 (or sheet processing unit), and an impression cylinder 19 of the printing unit 4 are each embodied double-sized, and are each provided with two diametrically opposed rows of grippers for holding the sheet.

The feed drum 16 transfers the sheet in register from the pre-gripper 15 to the sheet transport drum 17 which, in turn, transfers the sheet to the printing unit 4 (or sheet processing unit). The sheet transport cylinder 18 takes over the sheet from the sheet transport drum 17 and transfers the sheet to the impression cylinder 19 whereon the sheet is printed by an applicator cylinder 20 of the printing unit 4.

A flexographic printing form or a rubber blanket can be mounted selectively on the applicator cylinder.

The applicator cylinder 20 is inked by a zoneless metering device of the printing unit 4, the zoneless metering device including a screen or anilox roller 21 that rolls along the applicator cylinder 20, and a chambered doctor blade 22 that fills the screen or dot-matrix structure with ink or varnish.

The printing unit 6 (or further sheet processing unit) is structurally identical with the printing unit 4, except for the zoneless metering device. In the case of the printing unit 6, the zoneless metering device does not include a screen roller and a chambered doctor blade, but instead, an ink-filled or varnish-filled tub 23, an immersion or dip roller 24 disposed in the tub, and a metering roller 25 in contact with the dip roller 24.

The sheet feeding unit 3 serving for aligning the sheet and transferring it with precise fit and in-register to the printing unit 4 has a frame (side walls 12 and 13) that is formed separately and apart from a frame, which is formed of side walls 26 and 27, of the printing unit 4, and a frame 28 of the sheet separating unit 2. The frame (side walls 12 and 13) of the sheet feeding unit set up between the frame (side walls 26 and 27) of the printing unit 4 and the frame 28 is separated from the other two frames by dividing or parting lines 29 and 30.

The side walls 12 and 13 are disposed perpendicularly to the plane of the drawing, and have a mutual spacing like that of the side walls 26 and 27 and are arranged in abutting relationship with the latter. A self-contained overall form of the sheet-fed printing machine 1 is thereby produced therefrom. The units 2, 3 and 4 are solidly connected to one another by formlocking connections, such as screw fastenings, for example. In this regard, it is noted that a formlocking connection is one which connects two elements together due to the shape of the elements themselves, as opposed to a forcelocking connection, which locks the elements together by force external to the elements.

Reference numerals 31 and 32, respectively, identify two drying systems of the drying unit 5, which are directed towards a double-sized sheet transport cylinder 33 of the drying unit 5. Reference numeral 34 identifies a third drying system of the drying unit 5, the third drying system 34 being directed towards the impression cylinder 19 of the printing unit 4. A further drying system 35 is also directed towards the impression cylinder 19.

Each of the drying systems 8, 31, 32, 34 and 35 can be an ultraviolet (UV), infrared (IR) or thermal air (TL) dryer.

The Reference numeral 37 refers to a different sheet-fed printing machine which includes a diagram illustrated of feet printing unit 36. The sheet-fed printing machines 1 and 37 belong to one and the same building block system.

I claim:

1. A sheet-fed printing machine made up of units in an in-line construction, comprising:

a sheet-feeding unit disposed between a sheet separating unit and a sheet processing unit selected from various types of sheet processing units, said sheet feeding unit being formed as a separate unit with a separate frame to be selectively pre-arrangeable upline from the sheet processing unit independent of the sheet processing unit selected.

2. The sheet-fed printing machine according to claim 1, wherein said sheet processing unit is a printing unit.

3. The sheet-fed printing machine according to claim 1, including another sheet processing unit downstream of said sheet separating unit.

4. The sheet-fed printing machine according to claim 1, wherein said sheet feeding unit includes at least one lay mark.

5. The sheet-fed printing machine according to claim 1, wherein said sheet feeding unit includes a pre-gripper.

6. The sheet-fed printing machine according to claim 1, wherein said sheet feeding unit includes a feed drum.

7. The sheet-fed printing machine according to claim 1, wherein said sheet feeding unit includes a sheet transport drum.

8. The sheet-fed printing machine according to claim 7, wherein said sheet transport drum is a multiple of the size of the sheet.

9. The sheet-fed printing machine according to claim 2, wherein said printing unit is a flexographic printing unit.

10. The sheet-fed printing machine according to claim 2, wherein said printing unit includes a zoneless metering device.

11. The sheet-fed printing machine according to claim 10, wherein said metering device includes a screen roller and a chambered doctor blade.

12. The sheet-fed printing machine according to claim 1, wherein said sheet processing unit is a unit selected from the group consisting of an offset printing press unit, a letterpress unit, and a flexographic printing unit.

13. The sheet-fed printing machine according to claim 3, wherein the sheet-fed printing machine is a machine selected from the group consisting of an offset rotary printing machine, a flexographic rotary printing machine, and a hybrid printing machine.

14. A building block system for creating sheet-fed printing machines, comprising:

a first sheet processing unit having a first frame; a second sheet processing unit being of a type other than said first sheet processing unit; a sheet separating unit having a second frame; a sheet-feeding unit having a third frame; a first sheet-fed printing machine including said sheet separating unit and said first sheet processing unit; a second sheet-fed printing machine being of a type other than said first sheet-fed printing machine;

said sheet-feeding unit being formed so that said sheet-feeding unit is selectively pre-arrangeable, for creating said first sheet-fed printing machine, upline from said first sheet processing unit and, for creating said second sheet-fed printing machine, upline from said second sheet processing unit;

said sheet-feeding unit being disposed between said sheet separating unit and said first sheet processing unit if said sheet-feeding unit is pre-arranged upline from said first sheet processing unit for creating said first sheet-fed printing machine;

said sheet-feeding unit being disposed immediately upstream of said first sheet processing unit if said sheet-feeding unit is pre-arranged upline from said first sheet processing unit for creating said first sheet-fed printing machine; and said sheet-feeding unit being disposed immediately upstream of said second sheet processing unit if said sheet-feeding unit is pre-arranged upline from said second sheet processing unit for creating said second sheet-fed printing machine.

15. The building block system according to claim 14, wherein said first sheet processing unit is a printing unit.

16. The building block system according to claim 14, wherein said first sheet-fed printing machine includes a plurality of sheet processing units and said first sheet processing unit is a first one of said sheet processing units.

17. The building block system according to claim 14, wherein said sheet feeding unit includes at least one lay mark.

18. The building block system according to claim 14, wherein said sheet feeding unit includes a pre-gripper.

19. The building block system according to claim 14, wherein said sheet feeding unit includes a feed drum.

20. The building block system according to claim 14, wherein said sheet feeding unit includes a sheet transport drum.

21. The building block system according to claim 20, wherein said sheet transport drum is configured such that the circumference of said sheet transport drum is at least twice as large as the sheet format length.

22. The sheet-fed printing machine according to claim 15, wherein said printing unit is a flexographic printing unit.

23. The building block system according to claim 15, wherein said printing unit includes a zoneless metering device.

24. The building block system according to claim 23, wherein said metering device includes a screen roller and a chambered doctor blade.

25. A building block system for creating sheet-fed printing machines, comprising:

a first sheet processing unit having a first frame; a second sheet processing unit being of a type other than said first sheet processing unit; a sheet separating unit having a second frame; a sheet-feeding unit having a third frame, said third frame having side walls; a first sheet-fed printing machine including said sheet separating unit and said first sheet processing unit; a second sheet-fed printing machine being of a type other than said first sheet-fed printing machine;

said sheet-feeding unit being formed so that said sheet-feeding unit is selectively pre-arrangeable, for creating said first sheet-fed printing machine, upline from said first sheet processing unit and, for creating said second sheet-fed printing machine, upline from said second sheet processing unit;

said sheet-feeding unit being disposed between said sheet separating unit and said first sheet processing unit if said sheet-feeding unit is pre-arranged upline from said first sheet processing unit for creating said first sheet-fed printing machine;

said sheet-feeding unit being disposed immediately upstream of said first sheet processing unit if said sheet-feeding unit is pre-arranged upline from said first sheet processing unit for creating said first sheet-fed printing machine;

said sheet-feeding unit being disposed immediately upstream of said second sheet processing unit if said sheet-feeding unit is pre-arranged upline from said second sheet processing unit for creating said second sheet-fed printing machine; and a lay mark being supported between said side walls.

26. A building block system for creating sheet-fed printing machines, comprising:

a first sheet processing unit having a first frame; a second sheet processing unit being of a type other than said first sheet processing unit; a sheet separating unit having a second frame; a sheet-feeding unit having a third frame, said third frame having side walls; a first sheet-fed printing machine including said sheet separating unit and said first sheet processing unit; a second sheet-fed printing machine being of a type other than said first sheet-fed printing machine;

said sheet-feeding unit being formed so that said sheet-feeding unit is selectively pre-arrangeable, for creating said first sheet-fed printing machine, upline from said first sheet processing unit and, for creating said second sheet-fed printing machine, upline from said second sheet processing unit;

said sheet-feeding unit being disposed between said sheet separating unit and said first sheet processing unit if said sheet-feeding unit is pre-arranged upline from said first sheet processing unit for creating said first sheet-fed printing machine;

said sheet-feeding unit being disposed immediately upstream of said first sheet processing unit if said sheet-feeding unit is pre-arranged upline from said first sheet processing unit for creating said first sheet-fed printing machine;

said sheet-feeding unit being disposed immediately upstream of said second sheet processing unit if said sheet-feeding unit is pre-arranged upline from said second sheet processing unit for creating said second sheet-fed printing machine; and a pre-gripper being supported between said side walls.

27. A building block system for creating sheet-fed printing machines, comprising:

a first sheet processing unit having a first frame; a second sheet processing unit being of a type other than said first sheet processing unit; a sheet separating unit having a second frame; a sheet-feeding unit having a third frame; a first sheet-fed printing machine including said sheet separating unit and said first sheet processing unit; a second sheet-fed printing machine being of a type other than said first sheet-fed printing machine;

said sheet-feeding unit being formed so that said sheet-feeding unit is selectively pre-arrangeable, for creating said first sheet-fed printing machine, upline from said first sheet processing unit and, for creating said second sheet-fed printing machine, upline from said second sheet processing unit;

said sheet-feeding unit being disposed between said sheet separating unit and said first sheet processing unit if said sheet-feeding unit is pre-arranged upline from said first sheet processing unit for creating said first sheet-fed printing machine;

said sheet-feeding unit being disposed immediately upstream of said first sheet processing unit if said sheet-feeding unit is pre-arranged upline from said first sheet processing unit for creating said first sheet-fed printing machine;

said sheet-feeding unit being disposed immediately upstream of said second sheet processing unit if said sheet-feeding unit is pre-arranged upline from said second sheet processing unit for creating said second sheet-fed printing machine; and said first sheet-fed printing machine having a feeding table protruding into said sheet-feeding unit.

* * * * *